US006928410B1

(12) United States Patent
Marila et al.

(10) Patent No.: US 6,928,410 B1
(45) Date of Patent: Aug. 9, 2005

(54) METHOD AND APPARATUS FOR MUSICAL MODIFICATION OF SPEECH SIGNAL

(75) Inventors: Juha Marila, Taivassalo (FI); Sami Ronkainen, Oulu (FI); Mika Röykkee, Tampere (FI); Fumiko Ichikawa, Helsinki (FI)

(73) Assignee: Nokia Mobile Phones Ltd., Espoo (FI)

( * ) Notice: Subject to any disclaimer, the term of this patent is extended or adjusted under 35 U.S.C. 154(b) by 971 days.

(21) Appl. No.: 09/707,088

(22) Filed: Nov. 6, 2000

(51) Int. Cl.[7] ..... G10L 13/04
(52) U.S. Cl. ..... 704/268; 704/274
(58) Field of Search ..... 704/268, 270, 704/274, 260; 379/373.02; 455/567

(56) References Cited

U.S. PATENT DOCUMENTS

| | | | | | |
|---|---|---|---|---|---|
| 4,731,847 | A | * | 3/1988 | Lybrook et al. | 704/260 |
| 4,856,055 | A | * | 8/1989 | Schwartz | 379/373.02 |
| 5,452,354 | A | | 9/1995 | Kyronlahti et al. | 379/373.02 |
| 5,481,594 | A | * | 1/1996 | Shen et al. | 379/88.19 |
| 5,747,715 | A | * | 5/1998 | Ohta et al. | 84/609 |
| 5,826,064 | A | | 10/1998 | Loring et al. | 703/24 |
| 5,930,755 | A | * | 7/1999 | Cecys | 704/260 |
| 6,308,086 | B1 | * | 10/2001 | Yoshino | 455/567 |
| 6,385,581 | B1 | * | 5/2002 | Stephenson | 704/270 |
| 6,459,913 | B2 | * | 10/2002 | Cloutier | 455/567 |
| 6,697,796 | B2 | * | 2/2004 | Kermani | 707/3 |
| 2002/0085700 | A1 | * | 7/2002 | Metcalf | 379/210.01 |

FOREIGN PATENT DOCUMENTS

| | | | |
|---|---|---|---|
| JP | 5346787 | 12/1993 | G10H/7/00 |

* cited by examiner

*Primary Examiner*—Richemond Dorvil
*Assistant Examiner*—Donald L. Storm
(74) *Attorney, Agent, or Firm*—Ware, Fressola, Van Der Sluys & Adolphson LLP; Bradford Green

(57) ABSTRACT

A method and apparatus for modification of a speech signal indicative of a stream of speech data having a plurality of syllables. The method comprises the steps of mapping the stream of speech data from the speech signal into a stream of tone data according to a linguistic rule regarding the syllables for providing a tone signal indicative of the stream of tone data; forming a string of musical notes responsive to the tone signal for providing a carrier signal indicative of the string of musical notes; modulating the carrier signal with the speech signal for providing a modified signal; and providing an audible signal representative of the speech signal, musically modified according to the linguistic rule. The linguistic rule includes an assignment of a tone to a syllable of the speech data based on a vowel of the syllable, a consonant of the syllable, the intonation of the syllable for a monosyllabic language. The musically modified speech signal can be used to indicate an incoming telephone call, a message left on a telephone, a scheduled event, or the like.

27 Claims, 5 Drawing Sheets

METHOD AND APPARATUS FOR MUSICAL MODIFICATION OF SPEECH SIGNAL

FIELD OF THE INVENTION

The present invention relates generally to modulating an audio stream with another audio stream and, more particularly, to a vocoding method where a speech signal is used to modulate a string of periodic tones.

BACKGROUND OF THE INVENTION

The modulation of an audio stream indicative of speech data with another audio stream indicative of a periodic tone has been used to create synthetic music and certain sound effects. This modulation technique is usually referred to as vocoding, and the apparatus for vocoding speech is referred to as a vocoder or a phase vocoder. The term vocoding is derived from VOice CODING. Originally, the motivation for the development of the phase vocoder was to reduce the amount of data required for the transmission of speech over telephone lines or other speech signal transmission medium. For that purpose, vocoders extract pitch and voice information in order to time-compress the speech, and a phase vocoder may be considered as a series of bandpass filters, each having a center frequency. Through the bandpass filtering process, the speech signal is reduced to a series of signal segments carrying the center frequencies.

In an old-styled telephone set, the ringing tone that is used to signal an incoming telephone call is usually produced by a ringer repeatedly striking one or two bells. In a mobile phone, the ringing tone is produced by an electronic buzzer, which produces a pitch of a given frequency according to a value in a data stream representative of a series of musical tones. Likewise, in an electronic organizer or a personal digital assistant, such as a Palm Pilot, a beeping sound is used to remind the user of a scheduled event or the completion of a task requested by the user.

U.S. Pat. No. 5,452,354 (Kyronlahti et al.) discloses a ringing tone apparatus wherein subscriber identification information is used to generate the ringing tone. As disclosed in Kyronlahti el al., a ringing tone can be generated based on two or more binary digits of the subscriber identification number such as the mobile station identification number (MSIN), mobile identification number (MIN), etc. For example, if the lowest bits of the identification MSIN are described as a string of 11 binary digits, D10-D9-D8-D7-D6-D5-D4-D3-D2-D1-D0, these string of digits can be used to specify the parameters necessary for generating a ringing tone as follows: D1 and D0 are used to determine the duration of each ringing tone pulse; D3 and D2 are used to determine the frequency of the ringing tone pulses; D5 and D4 are used to determine the pulse number in one pulse sequence; D7 and D6 are used to determine the number of sequences to be repeated in the ringing tone; and D10, D9 and D8 are used to determine the silence period between pulse sequences. While this tone generation method is useful for producing different ringing tones for different subscribers, the ringing tones have no relevance to speech data, synthetic or natural. Japanese patent No. JP05346787 (Nakae Tetsukazu) discloses a method of extracting pitch data from a digital speech signal and generating a digital musical sound according to the pitch data. The digital speech signal and the digital musical sound are conveyed to a vocoder in order to generate a musical sound signal and a voice signal from which an envelope signal is produced. Finally, the sound signal is modulated with the envelope signal in order to add the nuance of a human voice to a musical sound. For most languages, the so-called musical sound, according to the pitch variation, is confined to one or two notes. For example, in a phrase like "I am Bond, James Bond", there is not much in pitch variation and the resulting musical sound signal may sound like EEE_EE. U.S. Pat. No. 5,826,064 (Loring et al.) discloses a user-configurable earcon event engine, wherein auditory cues are provided responsive to command messages issued by tasks executed on a computer system. As disclosed, the command messages include an index to an earcon data file, which, in turn, includes a reference to an audio file and audio parameter data for manipulating the acoustic parameters of an audio wave. However, the audio wave does not have the content of speech.

It is advantageous and desirable to provide a method and apparatus for modifying a carrier stream indicative of musical tones with a speech signal, wherein a broad range of musical tones can be exploited, regardless of the pitch variation in the speech signal.

SUMMARY OF THE INVENTION

The first aspect of the present invention is a method for modification of a speech signal indicative of a stream of speech data having a plurality of syllables. The method comprises the steps of:

mapping the stream of speech data from the speech signal into a stream of tone data according to a predetermined rule regarding the syllables for providing a tone signal indicative of the stream of tone data;

forming a string of musical notes responsive to the tone signal for providing a carrier signal indicative of the string of musical notes;

modulating the carrier signal with the speech signal for providing a modulated signal; and providing an audible signal representative of the speech signal, musically modified according to the predetermined rule.

Preferably, the predetermined rule includes a linguistic rule for assigning one, two or more notes to a syllable of the speech data based on a vowel of the syllable, a consonant of the syllable, or the intonation of the syllable.

It is also possible to assign one, two or more tones to a syllable of the speech data based on a combination of a vowel, a consonant and/or the intonation of the syllable. It is possible to assign a tone color (timbre), tempo, and/or a pitch range to the musical notes.

Preferably, the speech signal is provided in response to an incoming telephone call on a telephone, and the audible signal is indicative of the incoming telephone call.

Preferably, the speech signal is provided in response to a message on a telephone or a communicator, and the audible signal is indicative of the message.

Preferably, the speech signal is provided in response to a scheduled event in a personal digital assistance device, and the audible signal is indicative of the schedule.

Preferably, the speech signal is provided to indicate a user-interface event regarding an electronic device, wherein the user-interface event can be represented by an object positioned in the electronic device based on a hierarchy, and the predetermined rule is based on the position of the object in the hierarchy.

The second aspect of the present invention is an apparatus for modification of a speech signal indicative of a stream of speech data having a plurality of syllables. The apparatus comprises:

a mapping mechanism, responsive to the speech signal, for mapping the syllables into a stream of tone data based on a predetermined rule regarding the syllables, and for providing a tone signal indicative of the stream of tone data;

a forming mechanism, responsive to the tone signal, for providing a string of musical notes based on the stream of tone data, and for providing a carrier signal indicative of the string of musical notes;

a modulation mechanism, responsive to the carrier signal, for modulating the carrier signal with the speech signal, and for providing a modified speech signal indicative of the modulation; and a sound production device, responsive to the modified speech signal, for providing an audible signal representative of the speech signal, musically modified according to the predetermined rule.

Preferably the modified speech signal is further combined with the unmodified speech signal in order to adjust the musical content in the audible signal.

Preferably, the modulation mechanism is a phase vocoder, and the modulation is according to the process of vocoding.

The present invention will become apparent upon reading the description taken in conjunction with FIGS. 1 to 5.

DETAILED DESCRIPTION OF THE INVENTION

Figure 1:
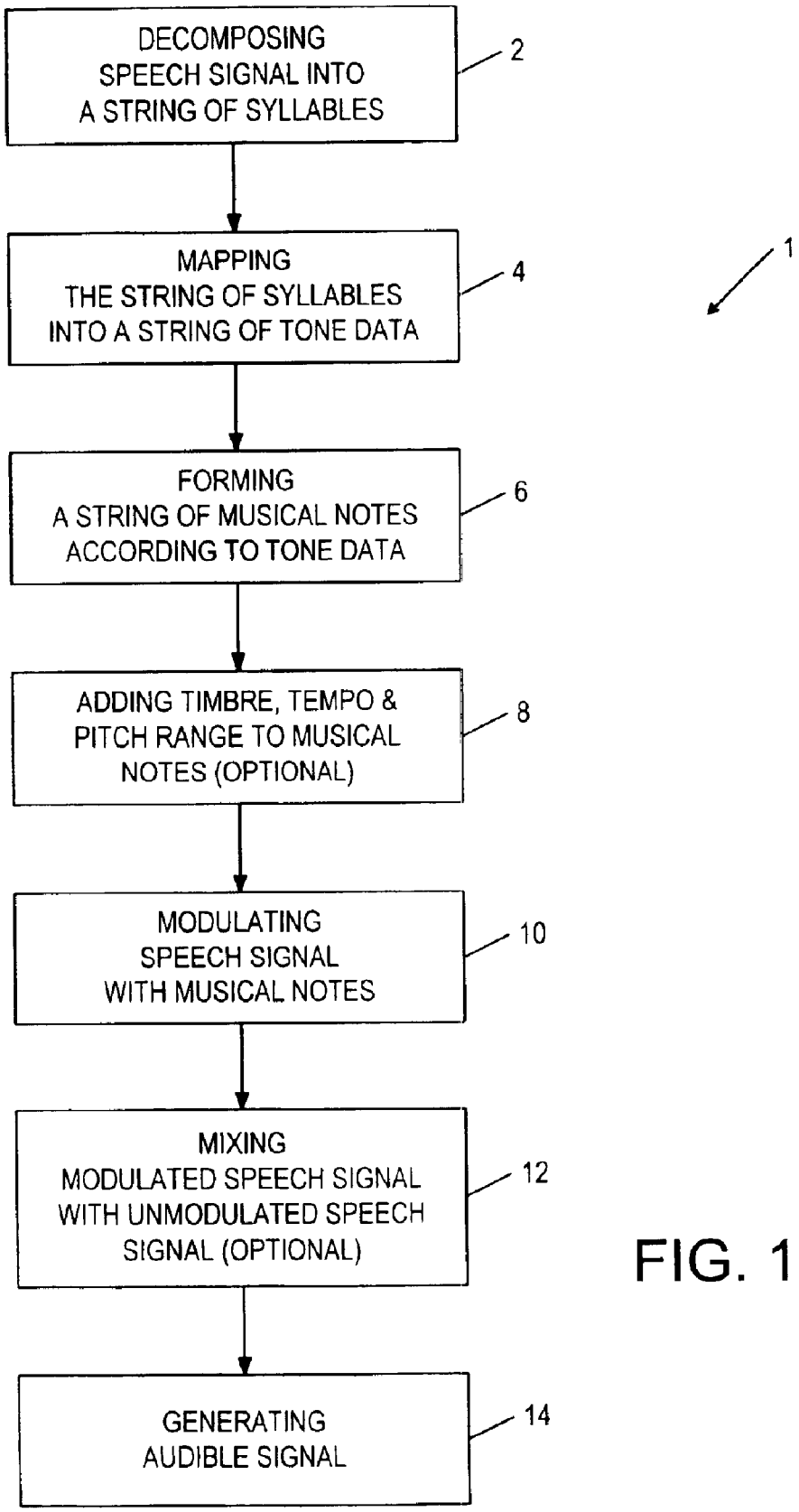
FIG. 1 is a flow chart illustrating the method for modification of a speech signal, according to the present invention.

Instead of producing a ringing tone in a telephone that has no relevancy to the user of the called party, it is advantageous to provide a musically modified speech signal to signal an incoming telephone call or to reminder the user of a message left by a called party. For example, it is possible to provide a musically modified speech signal derived from the user's name, or the name of the called party of an incoming phone call. In certain languages, such as Italian, Spanish and Japanese, personal names such as Giacomo Puccini, Pablo Picasso, Akira Kurosawa can be represented by a string of syllables as GIA-CO-MO_PUC-CI-NI, PA-BLO_PI-CAS-SO, A-KI-RA_KU-RO-SA-WA. These strings of syllables can be made into a string of musically modified speech data according to a simple rule based on the vowel, the consonant or a combination of a vowel and a consonant in each syllable. In particular, Japanese words and syllables are made up of kana symbols. The kana symbols make it easy to assign a syllable to a musical note in order to generate a string of musical notes indicative of the syllables. For example, the vowels a, i, u, e, o can be mapped onto five musical notes, namely, C, D, E, G. A, as shown in TABLE I.

TABLE I

VOWEL AS TONE DETERMINANT

| | | | | | | | | | | | |
|---|---|---|---|---|---|---|---|---|---|---|---|
| C= | a | ka | sa | ta | na | ha | ma | ya | ra | wa | n |
| D= | i | ki | shi | chi | ni | hi | mi | | ri | | |
| E= | u | ku | su | tsu | nu | fu | mu | yu | ru | | |
| G= | e | ke | se | te | ne | he | me | | re | | |
| A= | o | ko | so | to | no | ho | mo | yo | ro | o | |

Thus, when a syllable includes a vowel 'u', as in 'ku', 'tsu', etc, is assigned the musical note E. Following this linguistic rule, we have Fumiko Ichikawa (FU-MI-KO_I-CHI-KA-WA)=EDA_DDCC Akira Kurosawa (A-KI-RA_KU-RO-SA-WA)=CDC_EACC Yukio Mishima (YU-KI-O_MI-SHI-MA)=EDA_DDC.

The symbol '_' signifies a pause the length of which can be made equal to or different from the musical notes. With a similar rule, a string of syllables such as "I-AM-BOND_JAMES-BOND" may be mapped into a string of musical notes as DCA_CA.

Similarly, a linguistic rule can be set up based on the consonant of the syllables. For example, the musical note C can be assigned to 'ka', 'ki', 'ku', 'ke', 'ko', and A can be assigned to 'na', 'ne', 'nu', 'ne', 'no', as shown in TABLE II.

TABLE II

CONSONANT AS TONE DETERMINANT

| C | D | E | G | A | C2 | D2 | E2 | G2 | A2 |
|---|---|---|---|---|---|---|---|---|---|
| a | ka | sa | ta | na | ha | ma | ya | ra | wa |
| i | ki | shi | chi | ni | hi | mi | | ri | n |
| u | ku | su | tsu | nu | fu | mu | yu | ru | |
| e | ke | se | te | ne | he | me | | re | |
| o | ko | so | to | no | ho | mo | yo | ro | o |

It should be noted that 'n' has been moved to the second row, and C2 denotes an octave higher than C. To use consonants as tone determinant, the tone range of two octaves is sufficient. Following the linguistic rule as set forth in TABLE II, we have:

Fumiko Ichikawa (FU-MI-KO_I-CHI-KA-WA)=C2D2D_CGDA2

Akira Kurosawa (A-KI-RA_KU-RO-SA-WA)=CDG2_DG2EA2

Yukio Mishima (YU-KI-O_MI-SHI-MA)=E2DA2_D2ED2

In many Western languages, however, there may be too many different consonants and multi-consonants, such as pr, pl, tr, chr and spl, in the syllables to be mapped into musical notes within two or three octaves. It is possible to use a linguistic rule similar to the rule as set forth in TABLE III. The linguistic rules, as set forth in TABLE I and TABLE II, are based on a monophonic implementation of the pentatonic scale. TABLE III illustrates a rule that is based on a polyphonic implementation of the major Western scale for consonants and pentatonic for vowels.

TABLE III

| POLYPHONIC IMPLEMENTATION USING VOWELS AND CONSONANTS | | | | | | | | | | |
|---|---|---|---|---|---|---|---|---|---|---|
| | D | E | F | G | A | B | C | C2 | D2 | A2 |
| C | a | ka | sa | ta | na | ha | ma | ya | ra | wa |
| D | i | ki | shi | chi | ni | hi | mi | | ri | n |
| E | u | ku | su | tsu | nu | fu | mu | yu | ru | |
| G | e | ke | se | te | ne | he | me | | re | |
| A | o | ko | so | to | no | ho | mo | yo | ro | o |

Following the linguistic rule as set forth in TABLE III, we have

Fumiko Ichikawa (FU-MI-KO_I-CHI-KA-WA)=C2D2D_CGDA2 E D A_DDCC

Akira Kurosawa (A-KI-RA_KU-RO-SA-WA)=CDG2_DG2EA2 CDC_EA C C

Yukio Mishima (YU-KI-O_MI-SHI-MA)=E2DA2_D2ED2 E D A_D D C

Furthermore, the voiced/unvoiced (nigori/maru) and compound kana characters can be mapped to the closest equivalent syllables in the system, or they can be designated their own musical notes. Moreover, when a string of musical notes derived from a name according to one rule (e.g., the vowel rule) sounds too monotonic, it is possible to substitute it with a string of musical notes using another rule (e.g, the consonant rule). The nigori symbols (ga, gi, gu, ge, go), (za, ji, zu, ze, zo), (da, ji, du, de, do) and (ba, bi, bu, be, bo), are derived from, respectively, the upper-case characters (ka, ki, ku, ke, ko), (sa, shi, su, se, so), (ta, chi, tzu, te, to) and (ha, hi, fu, he, ho). When they are combined with other words to become compounds, the characters from which they are derived become voiced. For example, hana (nose), plus chi (blood), combine to form hanaji, and the character, chi, becomes voiced. When treated as syllables in compounds, the nigori symbols can be mapped to the same musical notes as the characters from which they derived, if so desired. Similarly, the maru symbols (pa, pi, pu, pe, po) can be mapped to the same musical notes as the upper-case characters of (ta, chi, tzu, te, to) from which they are derived. As for the lower-case compound characters, kya, kyu, kyo, gya, gyu, gyo, cha, etc., they can be mapped to the closest equivalent syllables in the system, but they can have a different tempo or time-stretch. For example, ki and kya can be mapped to the same musical note with different durations or different tone colors. Another symbol, the lower-case tsu, doubles the next consonant when it is placed before that consonant. For example, by placing tsu before ka, ka is stretched out as kka. Accordingly, kka can be mapped to the same musical note as ka with a longer duration.

In languages such as Chinese and Vietnamese, a plurality of intonations are used to modify the pronunciation of single-syllable words. In Mandarin Chinese, four intonations are used to modify the pronunciation, and the intonations are denoted herein with subscripts 1, 2, 3 and 4. For example, the different intonations applied to 'ba' are:

$ba_1$ (eight), $ba_2$ (to pull out), $ba_3$ (target), $ba_4$ (dam)

It is thus possible to assign four different musical tones such as C, D, G, A to the intonations 1, 2, 3, 4 as further shown in TABLE IV:

TABLE IV

| INTONATION AS TONE DETERMINANT | | | |
|---|---|---|---|
| C | $ba_1$ (eight) | $tan_1$ (greedy) | $xing_1$ (star) |
| D | $ba_2$ (to pull out) | $tan_2$ (to chat) | $xing_2$ (model) |
| G | $ba_3$ (target) | $tan_3$ (flat) | $xing_3$ (to wake up) |
| A | $ba_4$ (dam) | $tan_4$ (charcoal) | $xing_4$ (apricot) |

Following this linguistic rule, the musical notes assigned to the Chinese pronunciation of the late Japanese writer Yukio Mishima would be:

$san_1$ $daO_3$_$YOU_2$ $ji_4$ $fu_1$=CG_DAC

With rules as illustrated above, it is possible to assign a music note to a syllable in a speech signal in a variety of languages in accordance with the vowel, the consonant, or the intonation of the syllable.

It should be noted that, in a communication device such as a telephone, when using synthetic speech to make an announcement, the speech signal can simply be a stream of speech data having a plurality of syllables. From these syllables, it is possible to form a stream of musical notes based on a selected linguistic rule. The stream of musical notes can then be used as a carrier stream to musically modify, the stream of speech data. The musically modified speech data can be conveyed to a sound-producing device to make an audible signal. As such, the speech content is transformed into a musical form. Depending on the nature of the speech data, the musically modified speech data may or may not bear resemblance to the speech signal. Thus, it is possible to mix the musically modified speech data with the unmodified speech data. The mixing proportion can be adjusted so that the resulting sound will sound like speech having a certain mix of musical characteristics.

The linguistic rules, as described above, can also be used in an electronic device to provide auditory cues indicating a user-interface (UI) event. Typically, the UI events on an electronic device, such as a computer, are represented by objects or icons. According to the present invention, the UI objects or icons are further represented by auditory icons so that the user of the electronic device can be notified of the UI events using the auditory cues. For example, an auditory icon for arriving e-mail could be represented by musically modified syllables of "mes-sa-ges". The musical notes can be assigned to these syllables according to the vowel, the consonant or the syllabic intonation. Similarly, the UI event of "reply to a message" could be represented by musically modified syllables of "re-ply-to-mes-sage". It should be noted that the objects in device UI can be categorized in a hierarchical manner. For example, the hierarchy of a UI event indicates whether the event is related to a folder, a file, or the file's place in the file list. The division and the placement of objects in device UI can be further indicated by timbre, tempo and a pitch range. Timbre is a tone color of a sound, imitating the sound of a piano, an English horn, a flute and so forth. Tempo is a measure of time, or the duration, of each musically modified syllable. TABLE V lists a few examples of the auditory cues representing UI events, wherein the musical notes are assigned to the syllable according to syllabic intonation.

TABLE V

TEMPO AND PITCH RANGE ASSIGNMENT BASED ON HIERARCHY LEVEL

| Hierarchy level | UI function | Timbre | Pitch range | Tempo | Melody | Speech |
|---|---|---|---|---|---|---|
| 1 | Messages | English horn | 2 | 100 | G2-E2-C2 | Messages |
| 1 | Calendar | Electric piano | 2 | 100 | A2-D2-F#2 | Calendar |
| 2 | Inbox (Messages) | English horn | 3 | 100 | E3-C3-G2-C3-C3 | Messages inbox |
| 2 | View day notes (Calendar) | Electric piano | 3 | 100 | F#3-D3-A2 | View day notes |
| 3 | Reply (to a message) | English horn | 3 | 140 | F3-E3-C3-G2-C3 | Reply to message |
| 3 | Delete a calendar note | Electric piano | 3 | 140 | B3-A3-F#3-D3 | Delete the note |

Accordingly, the vocoded end result is as follows:

Messages (MES-SA-GES)=G2E2C2

Calendar (CAL-END-AR)=A2D2F#2

Inbox {Messages} (MES-SA-GES_IN-BOX)=E3C3G2_C3C3

View day notes {Calendar} (VIEW_DAY_NOTES)=F#3_D3_A2

Delete the note (DEL-ETE_THE_NOTE)=B3A3_F#3_D3

In the examples shown above, the musical form for each UI event is designed such that there are as many musical notes as the spoken content has syllables. It should be noted that, while the mapping of musical notes to a string of syllables is predetermined by a linguistic rule, the assignment of the pitch range, timbre, and tempo to the objects of device UI is more or less arbitrary. It is more of a question of design.

The method 1 for musically modifying a speech signal, according to the present invention, is summarized in FIG. 1. As shown, the speech signal is organized into a string of syllables at step 2. Using a selected linguistic rule, the string of syllables is mapped into a string of tone data at step 4. The string of tone data is transformed into a carrier stream of musical notes at step 6. Optionally, the carrier stream of musical notes is modified to include timbre representing the sound of a musical instrument, at step 8. The carrier stream is modulated with the speech signal to produce a musically modified speech signal at step 10. Optionally, the musically modified speech signal is combined with the unmodified speech signal at step 12 so as to adjust the amount of musical content in the speech signal. It is understood that the resulting signal can be a completely musically modified speech signal or completely unmodified speech or anything in between. The resulting signal is conveyed to a sound-producing device to produce an audible signal at step 14.

Figure 2:
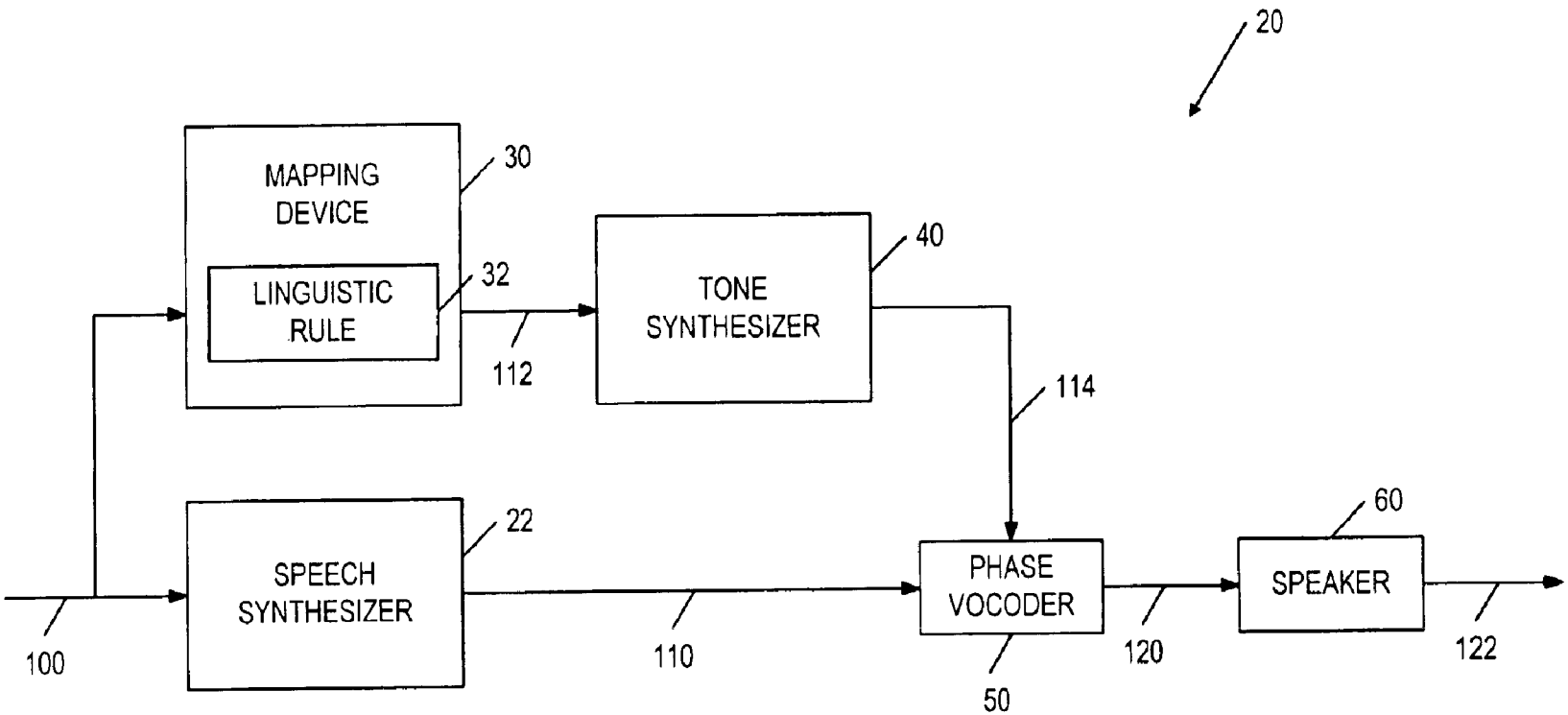
FIG. 2 is a block diagram illustrating the apparatus for modification of a speech signal, according to the preferred embodiment of the present invention.

FIG. 2 illustrates the apparatus 20 for musically modifying a speech signal 110, according to the preferred embodiment of the present invention. As shown in FIG. 2, when a string of speech data 100 is provided by a phone engine or a data processor (see FIGS. 3 and 4) to a speech synthesizer 22, the speech synthesizer 22 produces a speech signal 110 indicative of the speech data 100. Typically, the speech data 100 contains a string of syllables. A mapping device 30 is used to map the speech data 100 into a string of tone data 112 based ona linguistic rule 32. A tone synthesizer 40 is used to transform the string of tone data 112 into a carrier signal 114. It is possible that the tone synthesizer 40 includes a mechanism for including a tone color to the carrier signal 114 so that the carrier signal 114 has the timbre of a selected instrument. If the carrier signal 114 is fed to a sound producing device 60 to produce an audible signal, then the audible signal would be a string of musical notes played by the selected instrument. However, according to the present invention, the carrier signal 114 is modulated with the speech signal 110 in a modulator 50 in order to produce a musically modified speech signal 120. Based on the musically modified speech signal 120, the sound-producing device 60 produces an audible signal 122, which has both speech-like characteristics and musical characteristics. In that respect, the modification of the speech signal by the carrier signal containing a string of musical notes is somewhat related to the vocoding process, and the audible signal 122 can be referred to as a vocoded signal. Accordingly, the modulator 50 can be a phase vocoder.

Figure 3:
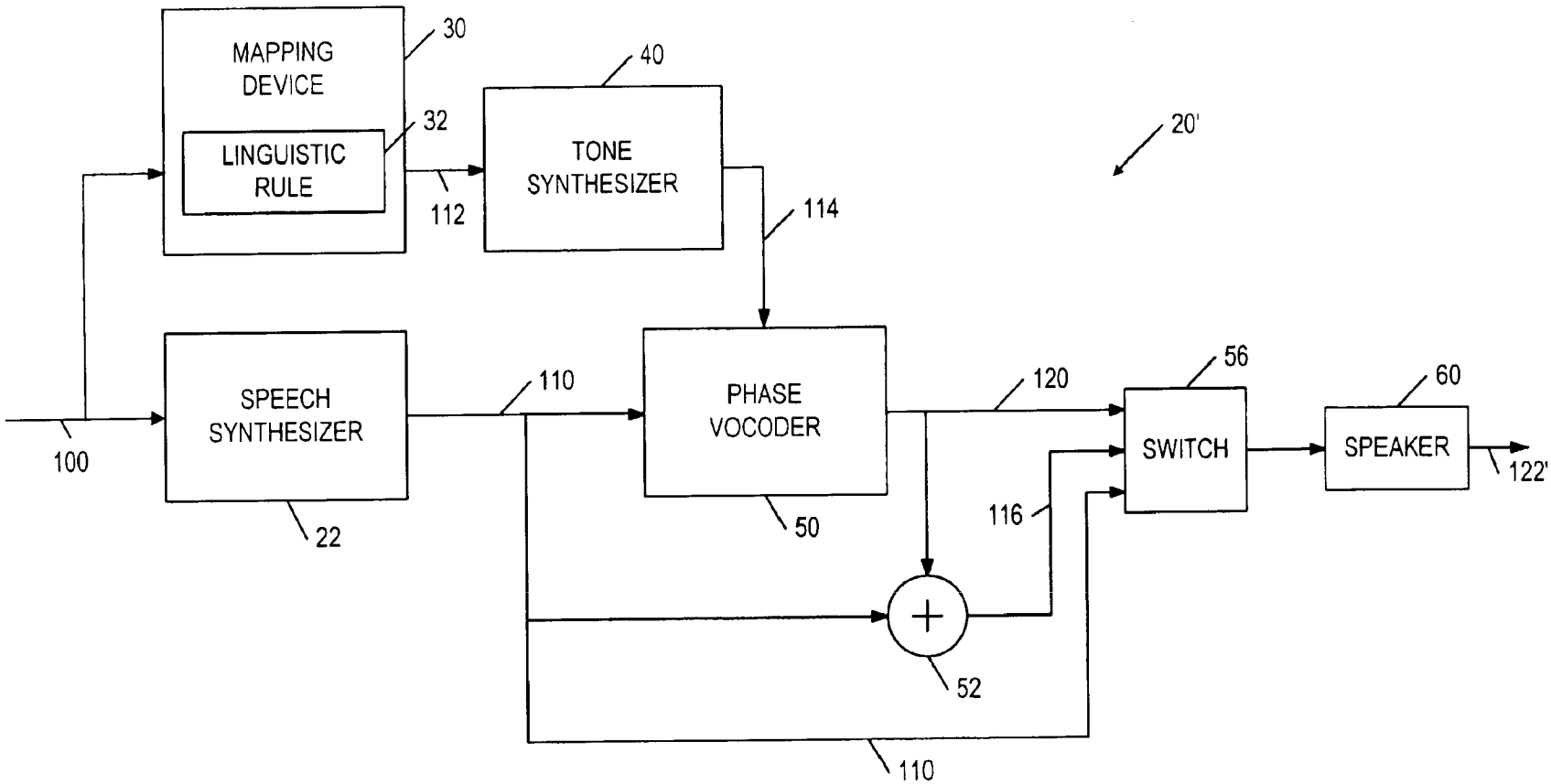
FIG. 3 is a block diagram illustrating another embodiment of the speech signal modification apparatus.

How much the audible signal 122 sounds like speech depends on a variety of factors. It may depend on the language itself, or on the linguistic rule (TABLE I to TABLE V, or the like). Thus, it is also preferred that the amount of musical modification be adjusted so that the audible signal 122 can be more speech-like than music-like. FIG. 3 illustrates another is embodiment of the apparatus 20' for musically modifying the speech signal 100, according to the present invention. As shown, the musically modified speech signal 120 is conveyed to a switch 56 before being fed into the sound-producing device 60. The musically modified speech signal 120 can be combined with the unmodified speech signal 110 in a mixer 52 in order to produce a mixed signal 116. The mixer 52 allows a user to adjust the amount of musical content in the mixed speech signal 116, which is conveyed to the switch 56. Furthermore, the unmodified speech signal 110 is also conveyed to the switch 56, so that a user can select which of the signals 110, 116 or 120 is to be used to generate the audible signal 122'. With the switch 56, the user can choose the audible signal 122' to be generated from the fully modified speech signal 120, the partially modified speech signal 116 or the unmodified speech signal 110. The selected speech signal is denoted by reference numerical 120'.

Figure 4:
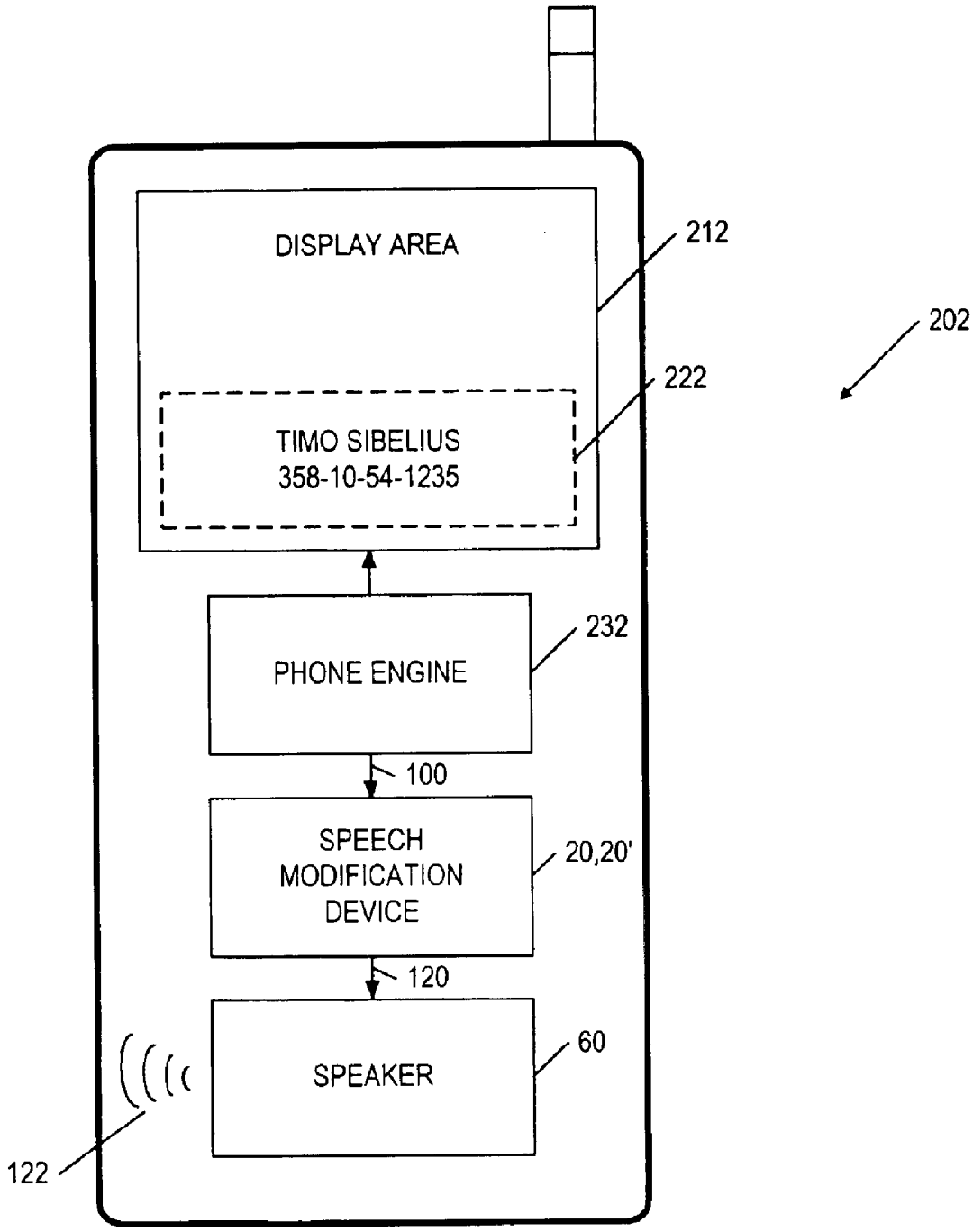
FIG. 4 is a diagrammatic representation illustrating a telephone or communicator in which a modified speech signal is used to indicate an incoming phone call.
Figure 5:
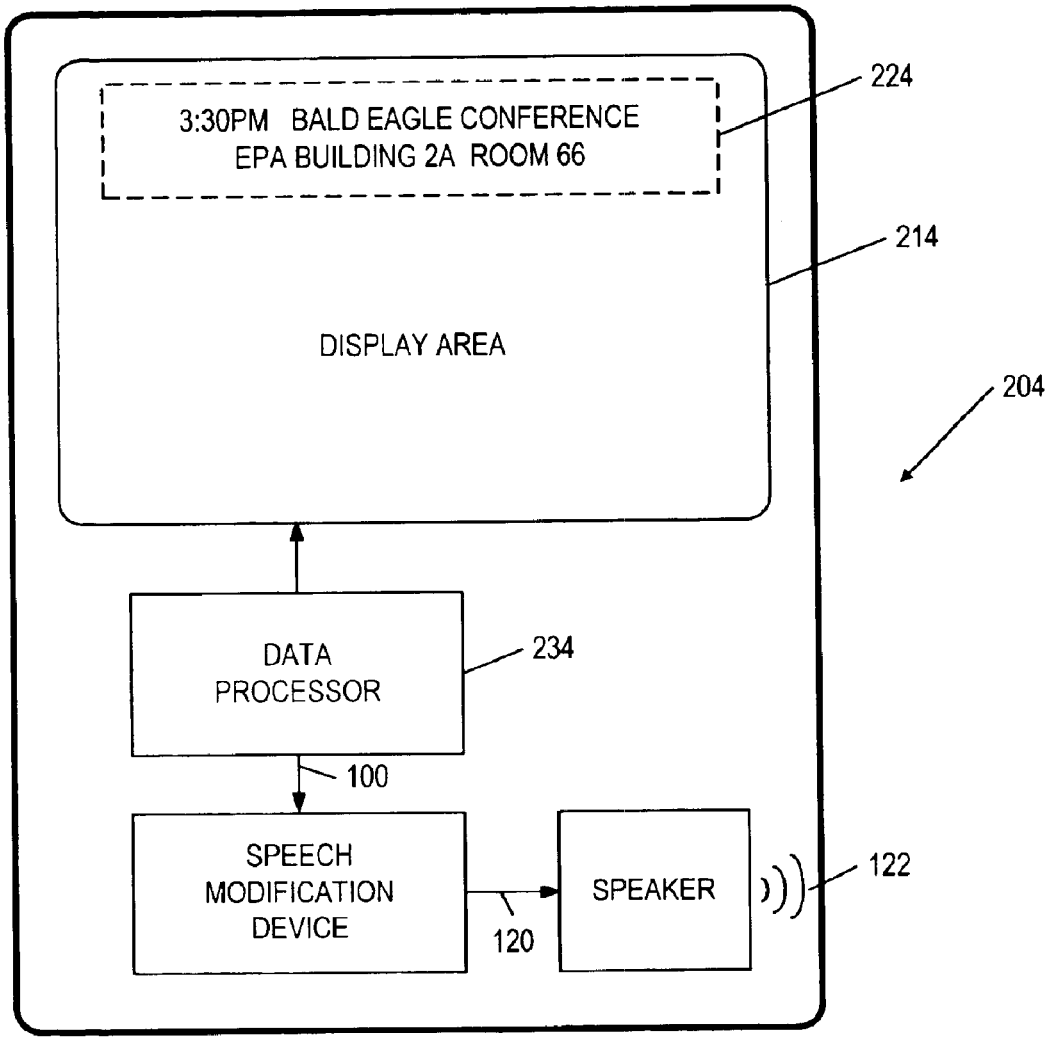
FIG. 5 is a diagrammatic representation illustrating an electronic organizer or a personal digital assistant device in which a modified speech signal is used to alert the user of an upcoming event.

The audible signal 122 can be used in many different ways. FIGS. 4 and 5 illustrate two examples. FIG. 4 shows a mobile phone 202 having an information display area 212. For example, the display area 212 can be used to display the name and phone number 222 of the calling party of an incoming call. In receiving the incoming call, a phone engine 232 produces a string of speech data 100 based on which apparatus 20 (or 20') produces the signal 120 (or 120'). The audible signal 122 (or 122') produced by the speaker 60 can be used, for example, as a ringing tone to signal the incoming call. The audible signal 122 can also be used to notify the telephone user of a message left by a calling party, or to alert the user when a search in the phone book contents is accomplished.

FIG. 5 shows an electronic organizer or a personal digital assistant (PDA) 204, which also has an information display area 214. It is well known that a personal digital assistant can be used as an address book, an appointment book and as information storage for various organizational functions. When the PDA 204 is used to keep track of one or more scheduled events, the PDA 204 can produce an audible signal 122 to alert the user of an upcoming scheduled event when the scheduled event is due or near, or indicate that a scheduled event or note has been deleted from a calendar. As shown, a scheduled event 224 is supplied to the display 214 by a data processor 234. At the same time, the data processor 234 produces a string of speech data 100 based on which the apparatus 20 (or 20') produces is the signal 120 (or 120'). When the PDA 204 is also used for transmitting and receiving e-mail messages, the audible signal 122 can be used to notify the user of the reception of a message by the PDA 204. The audible signal 122 can also be used to indicate the message is replied or deleted.

The vocoded signal, or the audible signal 122, as shown in FIGS. 4 and 5, can be used for many different purposes. The audible signal 122 can indicate the caller's name, the telephone user or the event. The audible signal 122 that is used to indicate a message can be different from the audible signal 122 that is used to indicate an incoming call. The audible signal 122 can be different from one time to another. There arc many linguistic rules different from those illustrated above. For example, one can combine the vowel, the consonant and the intonation rules within one rule. One can assign two notes to one syllable (e.g, FU-MI-KO_I-CHI-KA-WA=CE-BD-FA_BD-BD-AC-AC). One can also vary the duration of the musical notes in many different ways.

Thus, although the invention has been described with respect to the preferred embodiments thereof, it will be understood by those skilled in the art that the foregoing and various other changes, omissions and deviations in the form and detail thereof may be made without departing from the spirit and scope of this invention.

What is claimed is:

1. A method for modification of a speech signal indicative of a stream of speech data having a plurality of syllables, comprising:

mapping the stream of speech data from the speech signal into a stream of tone data according to a predetermined rule regarding the syllables for providing a tone signal indicative of the stream of tone data, wherein the predetermined rule is based on at least one linguistic characteristic of the syllables;

forming a string of musical notes responsive to the tone signal for providing a carrier signal indicative of the string of musical notes, such that said at least one linguistic characteristic is associated with a musical note;

modulating the carrier signal with the speech signal for providing a modified signal; and providing an audible signal representative of the speech signal, according to the modified signal, musically modified according to the predetermined rule.

2. The method of claim 1, wherein the predetermined rule includes an assignment of at least a tone to a syllable of the speech data, based on a vowel of the syllable.

3. The method of claim 1, wherein the predetermined rule includes an assignment of at least a tone to a syllable of the speech data, based on a consonant of the syllable.

4. The method of claim 1, wherein the predetermined rule includes an assignment of at least a tone to a syllable of the speech data, based on an intonation of the syllable.

5. The method of claim 1, wherein the predetermined rule includes an assignment of at least a tone to a syllable of the speech data, based on a combination of a vowel and a consonant of the syllable.

6. The method of claim 1, wherein the predetermined rule includes an assignment of tempo to the musical notes.

7. The method of claim 1, wherein the predetermined rule includes an assignment of a tone color to the carrier signal indicative of a musical instrument.

8. The method of claim 1, wherein the predetermined rule includes a linguistic rule based on language of the speech data.

9. The method of claim 1, wherein the speech signal is provided in response to an incoming telephone call on a telephone, and the audible signal is indicative of the incoming telephone call.

10. The method of claim 1, wherein the speech signal is provided in response to a message on a telephone or a communicator, and the audible signal is indicative of the message.

11. The method of claim 1, wherein the speech signal is provided in response to a scheduled event in a personal digital assistance device, and the audible signal is indicative of the scheduled event.

12. The method of claim 1, wherein the speech signal is provided in response to a search in phone book contents by a user, and the audible signal is indicative of the search being accomplished.

13. The method of claim 1, wherein the speech signal is provided in response to a user-interface event in an electronic device, and the audible signal is indicative of the user-interface event.

14. The method of claim 1, wherein the speech signal is provided in response to a user-interface event in an electronic device, wherein the user-interface event is arranged according to a hierarchy of positions in the electronic device, and the predetermined rule musically modifies the speech signal according to the position of the user-interface event in the hierarchy.

15. The method of claim 14, wherein the predetermined rule includes an assignment of a tone color to the carrier signal based on the position of the user-interface event in the hierarchy.

16. The method of claim 14, wherein the predetermined rule includes an assignment of a pitch range to the carrier signal based on the position of the user-interface event in the hierarchy.

17. An apparatus for modification of a speech signal indicative of a stream of speech data having a plurality of syllables, comprising:

a mapping mechanism, responsive to the speech signal, for mapping the syllables into a stream of tone data based on a predetermined rule regarding the syllables, and for providing a tone signal indicative of the stream of tone data, wherein the predetermined rule is based on at least one linguistic characteristic of the syllables;

a forming mechanism, responsive to the tone signal, for providing a string of musical notes based on the stream of tone data, and for providing a carrier signal indicative of the string of musical notes, such that said at least one linguistic characteristic is associated with a musical note;

a modulation mechanism, responsive to the carrier signal, for modulating the carrier signal with the speech signal, and for providing a modified speech signal indicative of the modulation; and a sound production device, responsive to the modified speech signal, for providing an audible signal representative of the speech signal, musically modified according to the predetermined rule.

18. The apparatus of claim 17, wherein the predetermined rule includes a linguistic rule based on language of the speech data.

19. The apparatus of claim 17, wherein the speech data is indicative of a user-interface event.

20. An electronic device, comprising:

a generating mechanism, responsive to a user-interface event, for providing a speech signal indicative of the user-interface event, wherein the speech signal includes a stream of speech data having a plurality of syllables;

a mapping mechanism, responsive to the speech signal, for mapping the syllables into a stream of tone data based on a predetermined rule regarding the syllables, and for providing a tone signal indicative of the stream of tone data, wherein the predetermined rule is based on at least one linguistic characteristic of the syllable;

a forming mechanism, responsive to the tone signal, for providing a string of musical notes based on the stream of tone data, and for providing a carrier signal indicative of the string of musical notes, such that said at least one linguistic characteristic is associated with a musical note;

a modulation mechanism, responsive to the carrier signal, for modulating the carrier signal with the speech signal, and for providing a modified speech signal indicative of the modulation; and a sound production device, responsive to the modified speech signal, for providing an audible signal representative of the speech signal, musically modified according to the predetermined rule.

21. The electronic device of claim 20, wherein the user-interface event includes an incoming telephone call using the electronic device.

22. The electronic device of claim 20, wherein the user-interface event includes an incoming telephone call using the electronic device, and the audible signal is indicative of the telephone call.

23. The electronic device of claim 20, wherein the user-interface event includes a message received by the electronic device, and the audible signal is indicative of the reception of the message.

24. The electronic device of claim 20, wherein the user-interface event includes a message received by the electronic device, and the audible signal is indicative of deletion of the message.

25. The electronic device of claim 20, wherein the user-interface event includes a scheduled event an a calendar, and the audible signal is indicative of the scheduled event.

26. The electric device of claim 20, wherein the user-interface event includes a scheduled event in a calendar, and the audible signal is indicative of entry of the scheduled event in the calendar.

27. The electronic device of claim 20, wherein the user-interface event includes a scheduled event in a calendar, and the audible signal is indicative of deletion of the scheduled event from the calendar.

* * * * *

UNITED STATES PATENT AND TRADEMARK OFFICE

CERTIFICATE OF CORRECTION

PATENT NO. : 6,928,410 B1
DATED : August 9, 2005
INVENTOR(S) : Marila et al.

It is certified that error appears in the above-identified patent and that said Letters Patent is hereby corrected as shown below:

Column 12,
Line 17, “an” should be -- in --.

Signed and Sealed this

Fifteenth Day of November, 2005

JON W. DUDAS
*Director of the United States Patent and Trademark Office*